United States Patent [19]

Harrison

[11] Patent Number: 4,875,799

[45] Date of Patent: Oct. 24, 1989

[54] TRAFFIC LANE MARKING DEVICE

[76] Inventor: George M. Harrison, 320 Salem Dr. (Apt. H), Vermillion, Ohio 44089

[21] Appl. No.: 240,623

[22] Filed: Sep. 6, 1988

[51] Int. Cl.[4] ..... E01F 9/06

[52] U.S. Cl. ..... 404/12; 404/14; 350/103

[58] Field of Search ..... 404/9, 10, 13, 14, 16; 116/63 R; 350/97, 102, 103

[56] References Cited

U.S. PATENT DOCUMENTS

| | | | |
|---|---|---|---|
| 1,364,950 | 1/1921 | O'Hara | 404/16 |
| 3,011,412 | 12/1961 | Harrington | 404/12 |
| 3,627,403 | 12/1971 | Hedgewick | 404/14 |
| 4,136,990 | 1/1979 | Morgan | 404/9 |
| 4,284,365 | 8/1981 | Rabinow | 404/9 |
| 4,303,305 | 12/1981 | Jones | 404/14 |
| 4,685,824 | 8/1987 | Eigenmann | 404/9 |

*Primary Examiner*—Jerome W. Massie, IV
*Assistant Examiner*—Gay Ann Spahn
*Attorney, Agent, or Firm*—A. Ray Osburn

[57] ABSTRACT

A night-visible traffic lane marking device for aircraft landing and takeoff strips, roadways and the like. The markers are installed embedded into the lane with their upper surfaces flush with the traffic surface. Reflective, fluorescent or phosphorescent elements are provided encased within a transparent uppermost layer. Each element extends vertically to provide a substantial profile for long distance visibility. The transparent covering extends a substantial distance from the reflective element in the direction of oncoming traffic, to increase long distance visibility.

13 Claims, 3 Drawing Sheets

TRAFFIC LANE MARKING DEVICE

BACKGROUND OF THE INVENTION

Field

This invention relates to the art of providing visual traffic marking devices for paved aircraft landing and takeoff strips and automobile roadways. Still more particularly, the invention concerns the utilization of retro-reflective and fluorescent materials and the like to provide nighttime visibility at safe distances from oncoming aircraft and ground vehicles.

State of the Art

Currently, the predominant material for traffic lane marking is light colored paint applied directly to the traffic surface. It is economical to apply, but is so rapidly eroded by traffic and weather that it must be replaced with costly frequency. It also suffers from inadequate visibility even at moderate distances. The patent literature describes several possibly more durable and visible traffic marking devices. U.S. Pat. No. 3,011,412 discloses a method of embedding beads or other auto-collimating units into a viscous, self-hardening resin based paint. The paint is applied upstanding from the traffic surface, as a center line strip, for example, and then covered with an erodeable or water soluble layer for temporary protection from traffic during the setting period. A pyramidal roadway reflector is disclosed in 3,627,403, designed to extend upwardly from a roadway surface. The sloping side faces of the pyramid incorporate reflective prisms covered by a transparent plastic layer. In 4,279,471, an elongate transparent base member is installed extending upwardly from a roadway surface. A reflective element is inserted into a lengthwise channel in the base member. All of these reflective devices protrude upwardly, obstructing and interrupting the smooth traffic surface, and constituting traffic hazards. Further, snow plows and other cleaning machines tend to damage such upstanding devices. In an attempt to alleviate this problem, 4,685,824 discloses a traffic marking device embedded with its upper surface even with the traffic surface. However, the only reflectivity provided is by surface beads or the like. No vertical profile is provided, so that its visibility is greatly reduced at moderate distances from the lights of the oncoming vehicles. Thus, the prior art reflective marking devices commonly either protrude upwardly from the traffic surface or suffer seriously decreased visibility from moderate distances. The latter shortcoming is particularly serious for airport landing and takeoff strips, often requiring visibility from up to a mile or more. Clearly, there is a need for a traffic marking device with long distance nighttime visibility, which does not interrupt the traffic surface, and is not rapidly eroded to require frequent maintenance and replacement.

BRIEF SUMMARY OF THE INVENTION

With the foregoing in mind, the disadvantages and shortcomings of prior art traffic lane guide markers are eliminated or substantially alleviated in the present invention, which provides a nighttime marker to be embedded into the pavement with its uppermost surface flush with the traffic-bearing surface. The marker comprises a highly visible, light responsive component shaped to provide a substantial vertical profile from the viewpoint of oncoming traffic. A layer of transparent material covers the high profile component, extending along the pavement a substantial distance therefrom toward oncoming traffic, rendering it visible from great distances. Preferably, the reflective component is contoured appropriately to promote the impingement of light thereon at desirable angles from the varying distances occurring as the oncoming vehicle approaches. The marker preferably further comprises a lowermost layer of firmly resilient material to increase its ability to resist wheel impact from traffic.

It is therefore the object of the invention to provide a highly durable traffic lane marker which does not protrude above the traffic surface,and which provides a high optical profile to be highly visible from approaching vehicles at great distances.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
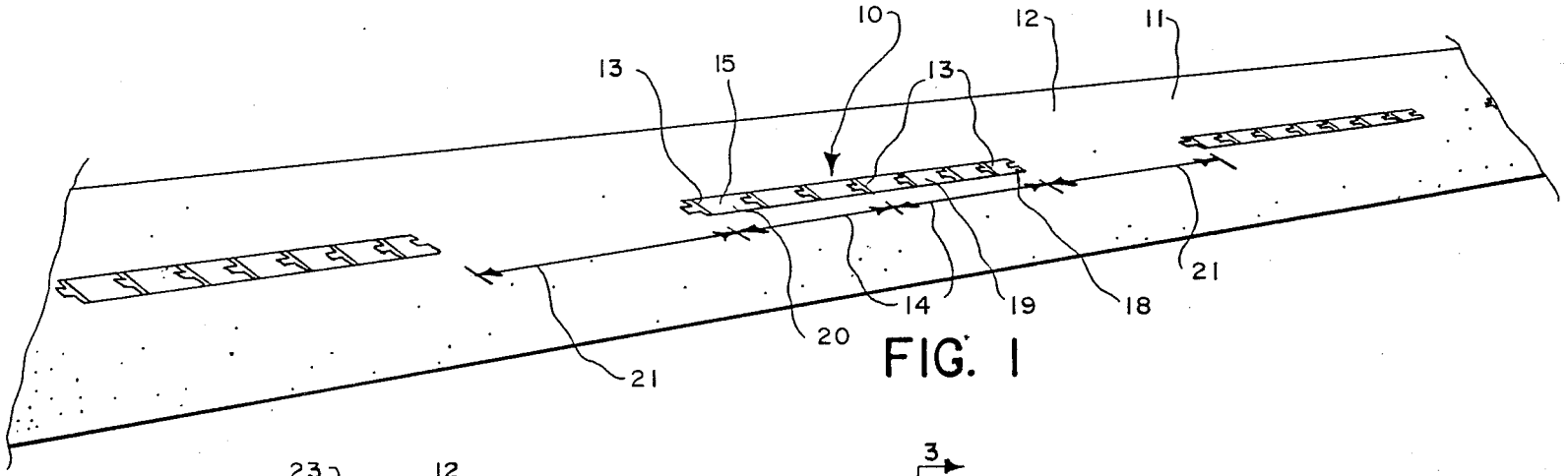
FIG. 1 is a perspective view of a fragment of an aircraft runway incorporating a traffic lane marking device in accordance with the invention, drawn to a reduced scale, FIG. 2 a plan view of fragments of a portion of the lane marker of FIG. 1, taken along line 2—2 thereof, drawn to a larger scale, FIG. 3 a vertical sectional view of fragments of the marker of FIG. 2, taken along line 3—3 thereof, drawn to a substantially larger scales than that of FIG. 2, FIG. 4 longitudinal vertical sectional view of fragments of the marker of FIG. 2, taken along line 4—4 thereof, drawn to the scale of FIG. 3, FIG. 5 a plan view of a fragment of an automobile roadway having center line reflective markers and side markers in accordance with the invention, drawn to a reduced scale, FIG. 6 a plan view of fragments of one of the center line marking assemblies of FIG. 5, drawn to a larger scale, and FIG. 7 a perspective view of one of the side markers of FIG. 5, drawn to a larger scale than that of FIG. 6.
Figure 2:
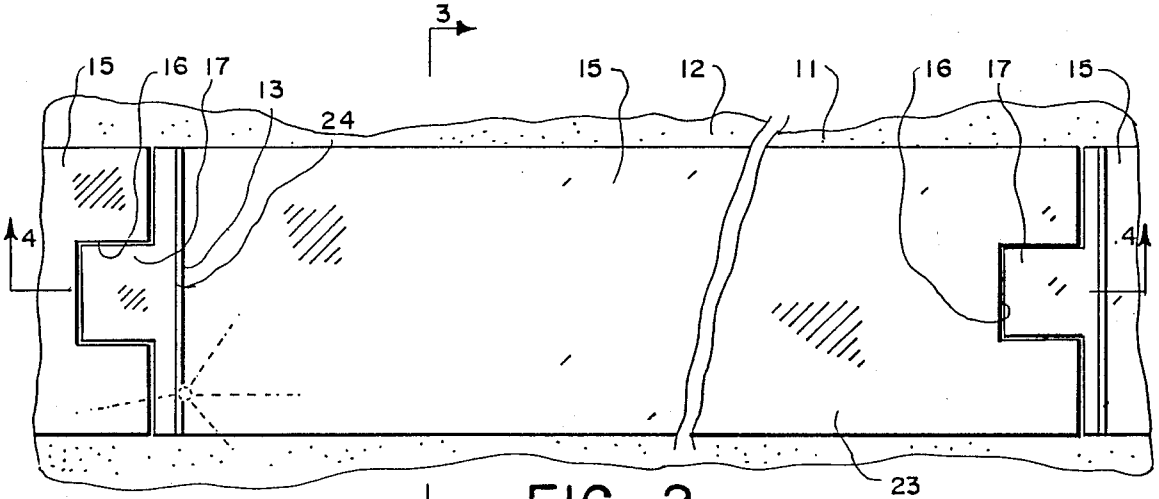
Figure 3:
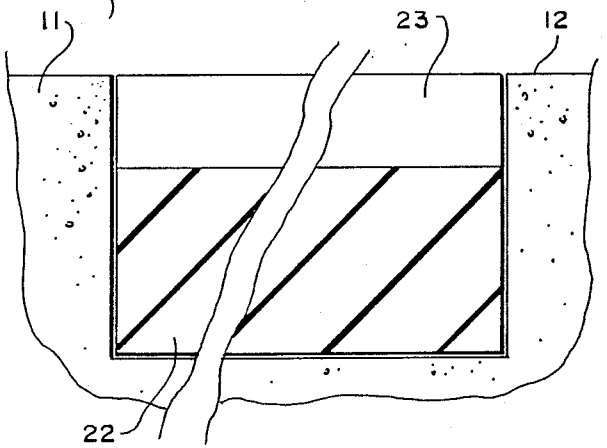

An embodiment of the traffic lane marking device 10 in accordance with the invention is shown in FIG. 1 embedded into an aircraft landing and takeoff strip 11 flush with the traffic surface 12. (FIG. 3) Transverse elongate light responsive components 13 are in this application preferably spaced at intervals 14 of approximately 30 feet, as required by the high speeds of landing and departing aircraft. Lane marker assembly 10 is constructed in large part of plastic materials. Because of mold size limitations, the elongate marker strip 10 may comprise, for example, six individual segments 15, each with interlocking notches 16 and mating projections 17. (FIGS. 2 & 4) For this application, only three segments 15 incorporate the reflective cross components 13. For even spacing, a cross component 13 is installed at the notched end of end segment 18, and at the projection carrying ends of middle segment 19 and opposite end segment 20. An interval 21 of approximately 40 feet is required between successive marking assemblies 10 by airport regulations.

Each individual segment 15 of assembly 10 comprises a lowermost layer 22 of firm resilient plastic in anticipation of aircraft wheel load impact, and a transparent uppermost layer 23. The latter may be of high strength, non-shattering glass or transparent plastic,such as Plexiglass or the like, selected for hardness, mechanical durability and long-life transparency. Bottom layer 22 of segments 18, 19 and 20 each carries an upwardly projecting transverse ridge 24. The cross components 13 each comprise a ridqe 24 with light responsive material 25 secured to its upstanding surfaces. A downwardly opening channel 26 in transparent top layer 23 accepts ridge 24. Material 25 may be fluorescent, phosphorescent or retroreflective. Prefabricated tape incorporating autocollimating reflective light beads, reflective prismatic objects or the like are all satisfactory reflective materials. Fluorescent or phosphorescent materials may also be incorporated into prefabricated tape if desired. Combinations or reflective, fluorescent and phosphorescent materials may be employed. A satisfactory reflective and fluorescent tape is part number C15FL-GRN-TC produced by General Formations, Inc., of Sparta, Michigan, for example.

Figure 4:
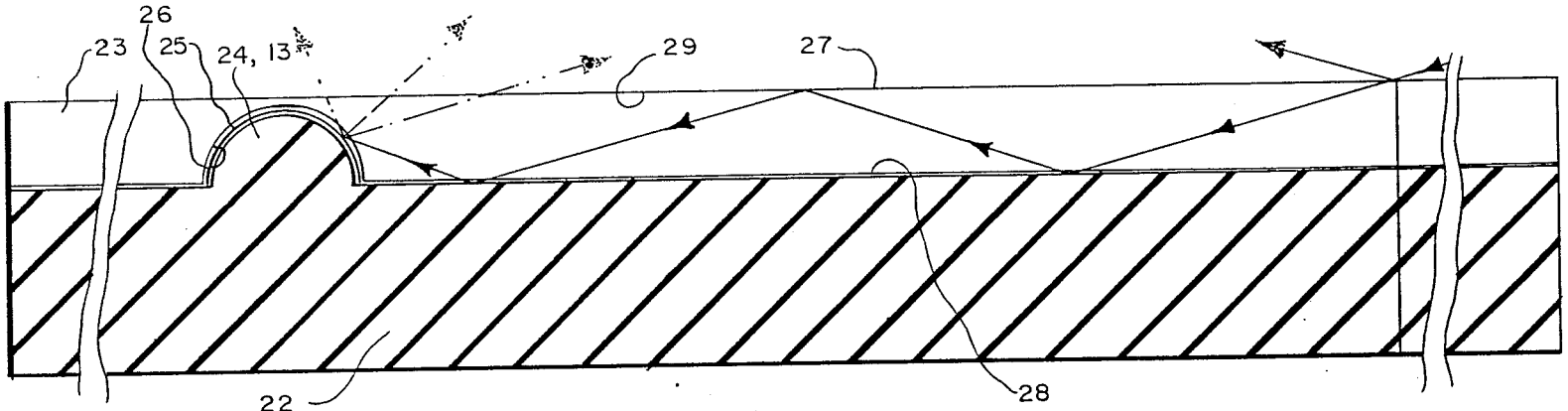

The light responsive ridges 24 are highly visible from great distances because they provide substantial vertical profiles to efficiently intercept light rays from distant oncoming vehicles. Ridge 24 is preferably shaped to present a curved surface, to help assure that the angles of incidents of impinging light rays from various distances will be appropriate for best reflection, retroreflection, fluoresence or the like. (FIG. 4)

Light rays from distant oncoming vehicles partially penetrate, but largely reflect from top surface 27 of transparent layer 23, because of the small angles of incidence. As the vehicles approach more closely, more penetration occurs. However, at all vehicle distances, transparent layer 23, acting similarly to light-transmitting optical fibers, retains and channels the penetrating rays toward the reflective ridges 24. The penetrating rays inside layer 23 reflect successively from the top side of the bottom surface 28 and the underside of the top surface 29, to ultimately impinge upon the light responsive material 25 on ridges 24.

For continued best visibility of ridges 24, top surface 27 of layer 23 is maintained by periodic cleaning. Snow may be removed with elastically-edged blades without damage to flushly installed strip assemblies 10. Debris may be removed by sweeping or brushing without scarring the surface.

Figure 5:
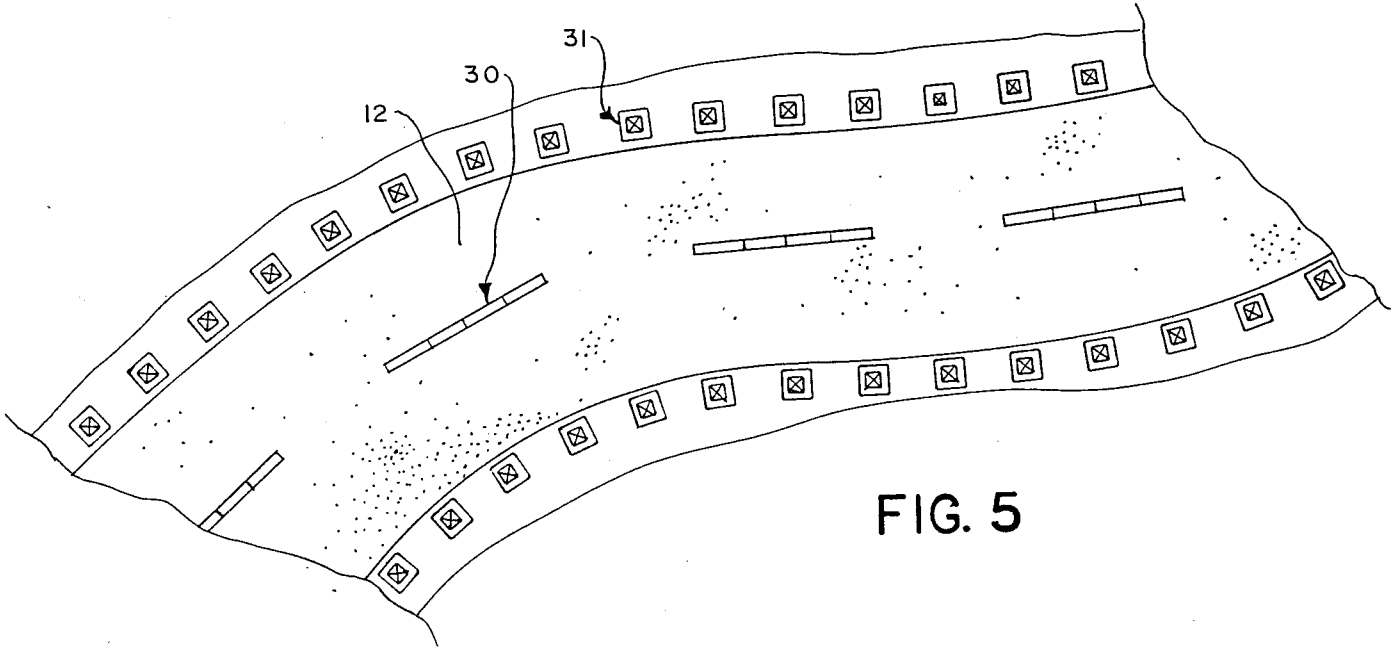
Figure 7:
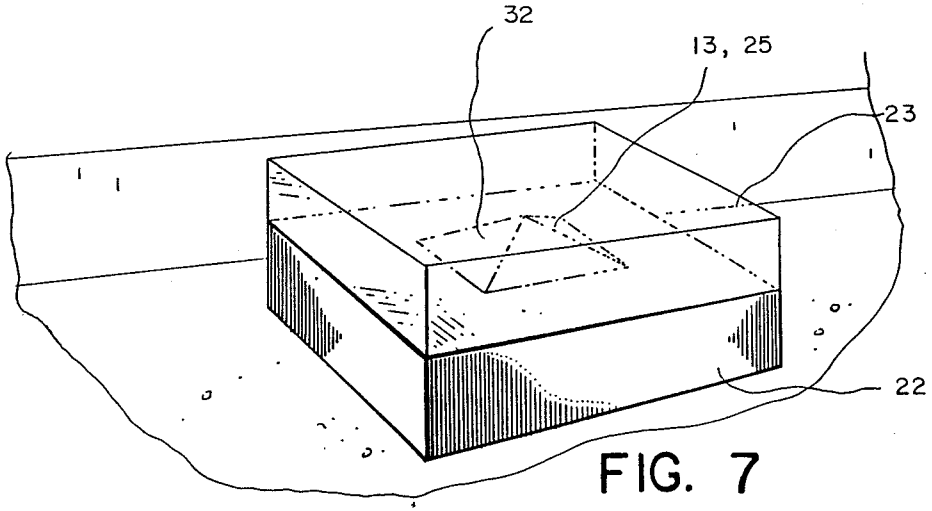
Figure 6:
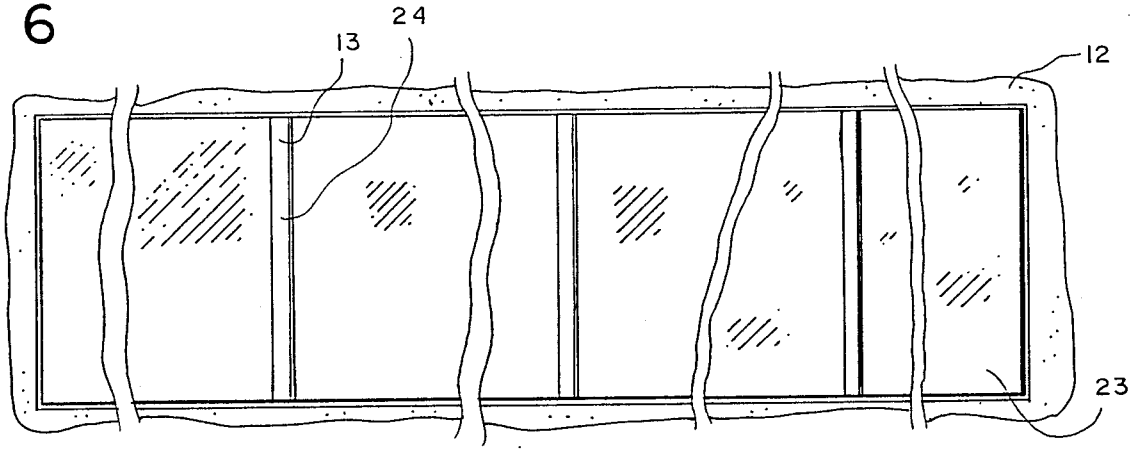

Retroflective assembly 10 may be constructed in appropriate sizes and configurations for other traffic lane marking applications. Example applications include highway center line markers 30, as well as highway side markers 31. (FIGS. 5–7) It is advantageous to provide side markers 31 with light responsive surfaces 32 arranged in pyramidal form, with appropriately colored reflective tape or the like on each separate pyramid face. For example, the faces projecting in the direction of traffic may appropriately be colored green, while the transversely projecting faces may be red or a similar warning color. Other light responsive materials 25 may be employed without departing from the spirit of the invention. For example, even state of the art highway marking paint would be visible at considerable distances with the high profiles of the marking components 24. The shape of the upstanding units 24 is also largely a matter of choice.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by U.S. Letters Patent is:

1. A night-visible traffic marking device for installation embedded into aircraft landing strips, vehicle roadways and the like, comprising:

a generally planar plate member of transparent material installed with its upper surface flush with the traffic contacting surface;

at least one night-visible object upstanding within the plate member to provide a substantial vertical profile from the point of view from an oncoming vehicle, the side of said object facing the vehicle being curved and including material selected to be highly visible when impinged upon by light from said vehicle.

2. The marking device of claim 1, wherein:

the transparent plate member extends a sufficient distance toward the direction of vehicle approach to enable light therefrom to fully illuminate the night-visible object from substantial distances.

3. The marking device of claim 2, further comprising:

a lowermost base layer of resilient material supporting the transparent plate member.

4. The marking device of claim 3, wherein:

the plate member is of molded transparent plastic; and the night-visible object is molded into the plate member.

5. The marking device of claim 3, wherein:

the plate member includes a downwardly opening recess; and the night-visible object is installed within the recess.

6. The marking device of claim 5, wherein the nightvisible object comprises:

a projection upstanding from the base layer in matching relationship with the recess; and the night-visible material is affixed to the upstanding surface of the projection.

7. The marking device of claim 6, wherein:

a plurality of night-visible objects are provided spaced apart in the direction of traffic.

8. The marking device of claim 7, wherein:

the transparent plate is elongate in the direction of traffic; and the night-visible object is elongate laterally to the direction of traffic.

9. The marking device of claim 8, wherein:

the plate member and the base each comprise at least two elongate segments joined in abutted aligned relationship.

10. The marking device of claim 3, wherein:

the highly visible material is selected from among light colored highway marking paint, light reflective prismatic material, reflective autocollimating beads, fluorescent material,phosphorescent material, and a combination of at least two of the preceding materials.

11. The marking device of claim 4, wherein:

the highly visible material is selected from among light colored highway marking paint, light reflective prismatic material, reflective autocollimating beads, fluorescent material, phosphorescent material, and a combination of at least two of the preceding materials.

12. The marking device of claim 6, wherein:

the highly visible material is selected from among light colored highway marking paint, light reflective prismatic material, reflective autocollimating beads, fluorescent material, phosphorescent material, and a combination of at least two of the preceding materials.

13. The marking device of claim 8, wherein:

the highly visible material is selected from among light colored highway marking paint, light reflective prismatic material, reflective autocollimating beads, fluorescent material, phosphorescent material, and a combination of at least two of the preceding materials.

* * * * *